US005411342A

United States Patent [19]

Horie et al.

[11] Patent Number: 5,411,342

[45] Date of Patent: May 2, 1995

[54] TERMINAL DEVICE

[75] Inventors: Kenzo Horie; Toshiaki Yamauchi, both of Yokohama, Japan

[73] Assignee: Matsushita Electric Industrial Co., Ltd., Osaka, Japan

[21] Appl. No.: 44,610

[22] Filed: Apr. 9, 1993

[30] Foreign Application Priority Data

Apr. 20, 1992 [JP] Japan ..... 4-099175

[51] Int. Cl.[6] ..... B41J 11/58

[52] U.S. Cl. ..... 400/613; 400/613.1; 400/619; 400/594

[58] Field of Search ..... 400/619, 613, 586, 594, 400/594.1, 609, 613.1, 615

[56] References Cited

U.S. PATENT DOCUMENTS

| | | | |
|---|---|---|---|
| 4,800,031 | 8/1989 | Lejcek | 400/613 |
| 4,904,100 | 2/1990 | Enix | 400/613 |
| 5,033,881 | 7/1991 | Koike . | |
| 5,060,877 | 10/1991 | Bullivant . | |
| 5,201,588 | 4/1993 | Sakai et al. | 400/613 |
| 5,230,576 | 7/1993 | Sone | 400/613 |
| 5,269,612 | 12/1993 | Shimoha et al. | 400/613 |

FOREIGN PATENT DOCUMENTS

| | | |
|---|---|---|
| 62-94855 | 6/1987 | Japan . |
| 170558 | 5/1989 | Japan . |

*Primary Examiner*—Edgar S. Burr
*Assistant Examiner*—John S. Hilten
*Attorney, Agent, or Firm*—Stevens, Davis, Miller & Mosher

[57] ABSTRACT

There is disclosed a terminal device. A paper roll cover is pivotally connected at its proximal end portion on a rear end portion of a paper roll receptacle portion so as to pivotally move into an open position where the paper roll cover is inclined slightly rearwardly. Position limiting members are provided on the inner side of the paper roll cover for holding a paper roll in registry with a paper insertion slot when the paper roll cover is in the open position. The paper roll is supported by the position limiting members, so that paper can be drawn out from a lower side of the paper roll by both hands, and can be positively inserted into the paper insertion slot. When the paper roll cover supporting the paper roll is pivotally moved into the closed position, the paper roll is caused to roll into the paper roll receptacle portion, so that the drawn-out portion of the paper is again wound on the paper roll.

8 Claims, 2 Drawing Sheets

TERMINAL DEVICE

BACKGROUND OF THE INVENTION

This invention relates to a terminal device, such as a small-size word processor, a firm banking terminal and a small-size personal computer, which contains a printer unit using a paper roll, and which is not provided with a support shaft for supporting the paper roll thereon, and instead in which the paper roll is set in a so-called throw-in manner.

Recently, terminal devices have been of a small size, and have had advanced functions, and those terminal devices containing a printer unit therein have become the standard type. In those of such terminal devices using a paper roll, whether or not the paper can be easily inserted is an important factor in the operability; however, this has not been much considered so far. Further, because of a demand for a low-cost design, the type of terminal devices in which the paper roll is set in a throw-in manner without the use of a support shaft for supporting the paper roll have now been increasingly used.

One such a conventional terminal device will now be described with reference to the drawings.

FIGS. 3 to 5 show a conventional terminal device of the type in which a paper roll is set in a throw-in manner. More specifically, FIG. 3 is a perspective view, showing a paper roll cover in its open condition, FIG. 4 is a side-elevational view of an important portion of the terminal device, showing the paper roll cover in its closed condition, and FIG. 5 is a cross-sectional view of an important portion of the terminal device, showing the paper roll in a set condition.

In FIGS. 3 to 5, a printer unit 52 is accommodated in a rear portion of a terminal device body 51. A paper insertion slot 53 for supplying paper P to the printer unit 52 from the paper roll is formed through a rear end wall of the body 51, and a paper discharge slot 54 for discharging the paper P, passed through the printer unit 52, is formed through an upper wall of the body 51 adjacent to the rear end thereof. A paper roll receptacle portion 55 is formed integrally on the rear end surface of the body 51, and comprises a bottom plate 56, an arcuate rear plate 57 extending rearwardly from the bottom plate 56, and opposite side plates 58 and 59, the paper roll receptacle portion 55 having an open top. The paper roll cover 60 comprises a top plate 61, a rear plate 62 extending rearwardly from the top plate 61, and opposite side plates 63 and 64, the bottom and the front of the paper roll cover 60 being open. The open bottom portion of the paper roll cover 60 fits on the open top portion of the paper roll receptacle portion 55, and the paper roll cover 60 is pivotally supported on the paper roll receptacle portion 55 by a pair of pivot pins 65. One of the pivot pins 65 is provided at central portions of the side plates 58 and 63, whereas the other pivot pin 65 is provided at central portions of the side plates 59 and 64. By pivotally moving the paper roll cover 60 about the pivot pins 65, the top of the paper roll receptacle portion 55 can be opened (see FIGS. 3 and 5), and by pivotally moving the paper roll cover 60 about the pivot pints 65 in the reverse direction, the top of the paper roll receptacle portion 55 can be closed (see FIG. 4).

The operation of the above terminal device will now be described.

First, as shown in FIG. 3, the paper roll cover 60 is pivotally moved about the pivot pins 65 to open the top of the paper roll receptacle portion 55. Then, the roll of paper P is held by one hand, and the leading end portion of the paper P is held by the fingers of the other hand, and in this condition the paper P is slightly fed and inserted into the paper insertion slot 53. Alternatively, the roll of paper P is placed on a suitable place lying rearwardly of the body 51, and then the leading end portion of the paper P is held by both hands, and is inserted into the paper insertion slot 53. Subsequently, the paper P is fed by a paper feed mechanism to pass through the printer unit 52, so that the leading end portion of the paper P is extended from the paper discharge slot 54. Thereafter, a slack of the paper P is eliminated, and the paper roll is received in the paper roll receptacle portion 55, as shown in FIG. 5, and then the paper roll cover 60 is pivotally moved about the pivot pins 65 to close the top of the paper roll receptacle portion 55 as shown in FIG. 4, thus completing the setting or loading of the paper roll.

In the above conventional terminal device, however, the leading end portion of the paper P is held by the fingers of one hand, and inserted into the paper insertion slot 53 while the paper roll is held by the other hand, and therefore it is difficult to insert the paper P straight into the paper insertion slot 53, and the paper P is often inserted obliquely into this slot 53, which may result in the jamming of the paper. And besides, as is clear from FIG. 4, to ensure that when the paper roll cover 60 is pivotally moved into the open position, the paper roll cover 60 can be disposed adjacent to the underside of the paper roll receptacle portion 55, each pivot pin 65 is disposed inwardly from the rear end surface by a distance equal to a radius R1 of the arcuate surface of the paper roll cover 60 or a radius R2 of the arcuate surface of the paper roll receptacle portion 55. As a result, as is clear from FIG. 5, in the open position of the paper roll cover 60, the distance between the paper insertion slot 53 and the paper roll cover 60 is relatively small, and is approximately equal to the diameter of the paper roll. Therefore, when the paper roll is held by one hand for inserting the paper P, the operator needs to feed a sufficient length of paper P from the paper roll, depending on his own judgment, so that the paper P can be inserted into the paper insertion slot 53. In this case, the projecting of the leading end of the paper P from the paper discharge slot 54 is confirmed, and then it is necessary to rewind the paper P to remove a slack of the fed paper when the paper roll is to be received in the paper roll receptacle portion 55. Further, when the paper P is fed from the paper roll, is placed on a suitable place lying rearwardly of the terminal device, and is to be inserted into the paper insertion slot 53, it is necessary to position the paper P with respect to the paper insertion slot 53 in its widthwise direction. And besides, when the paper P is pulled so as to insert the paper into the insertion slot 53, the paper roll P rollingly moves, in which case the paper roll must be rewound.

SUMMARY OF THE INVENTION

With the above problems of the prior art in view, it is an object of this invention to provide a terminal device in which paper from a paper roll can be inserted into a paper insertion slot in a stable condition, thereby facilitating the insertion of the paper.

Another object of the invention is to provide a terminal device in which a paper roll can be easily received in a paper roll receptacle portion after paper from the paper roll is inserted into a paper insertion slot.

According to the present invention, there is provided a terminal device comprising:

a paper roll receptacle portion for receiving a paper roll therein, the paper roll receptacle portion having an open top;

a paper roll cover pivotally mounted at its proximal end portion on a rear end portion of the paper roll receptacle portion so as to pivotally move between an open position where the paper roll cover opens the open top of the paper roll receptacle portion and a closed position where the paper roll cover closes the open top of the paper roll receptacle portion, the paper roll cover being capable of supporting the paper roll thereon when the paper roll cover is in the open position; and a position limiting member capable of holding the paper roll in registry with a paper insertion slot formed in a terminal device body when the paper roll cover is in the open position, the position limiting member allowing the paper roll to rollingly drop from the paper roll cover into the paper roll receptacle portion when the paper roll cover is moved from the open position to the closed position.

In the above terminal device, the length of straight drawing of paper from a lower side of the paper roll (which is supported on an inner side of the paper roll cover in its open position) to the paper insertion slot is shorter than the length of that portion of the paper roll receptacle portion with which the paper roll is in contact when the paper roll is received in the paper roll receptacle.

As described above, in the present invention, the axis of pivotal movement of the paper roll cover is provided at the rear end portion of the paper roll receptacle portion, and therefore the paper roll cover is opened about the pivotal axis to be disposed rearwardly of the paper roll receptacle portion, so that the paper roller cover can be sufficiently spaced from the paper insertion slot. Further, the position limiting member limits the position of the paper roll, supported on the inner side of the paper roll cover, in such a manner as to hold the paper roll in registry with the paper insertion slot. Thus, the paper roll supported on the paper roller cover in the open position can be held in registry with the paper insertion slot. And besides, the paper roll can be spaced a sufficient distance from the paper insertion slot, and therefore the paper can be drawn out from the paper roll and can be positively inserted into the paper insertion slot by both hands.

Furthermore, the length of straight drawing of paper from the lower side of the paper roll (which is supported on the inner side of the paper roll cover in its open position) to the paper insertion slot is shorter than the length of that portion of the paper roll receptacle portion with which the paper roll is in contact when the paper roll is received in the paper roll receptacle. With this arrangement, when the roll cover supporting the paper roll thereon is moved into the closed position, the paper roll can be set or loaded in position without producing a slack on the paper roll.

DESCRIPTION OF THE PREFERRED EMBODIMENT

One preferred embodiment of the present invention will now be described with reference to the drawings.

Figure 1:
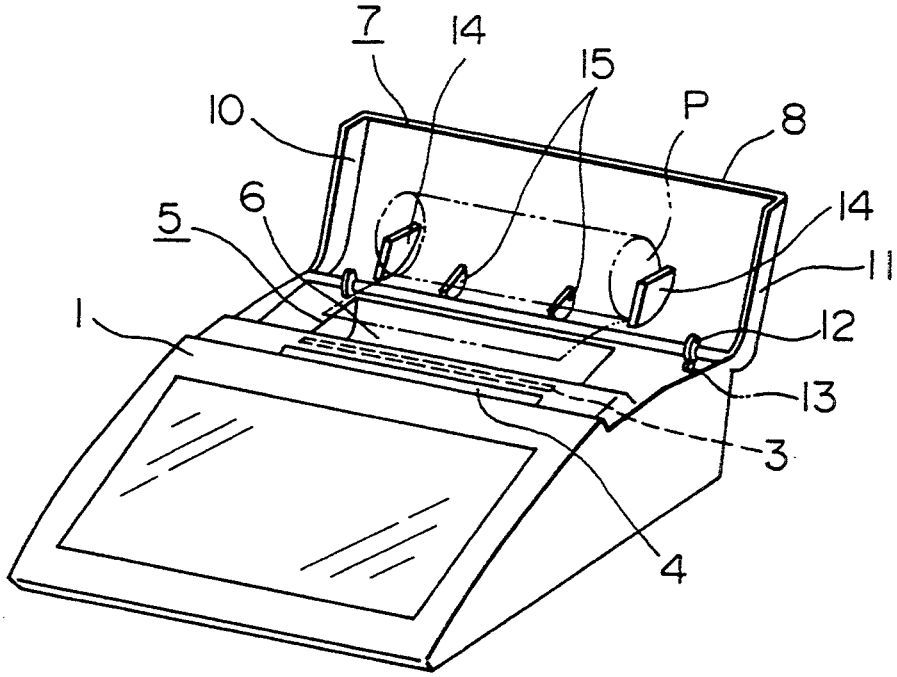
FIG. 1 is a perspective view of a terminal device of an embodiment of the present invention in an open condition of a paper roll cover.
Figure 2:
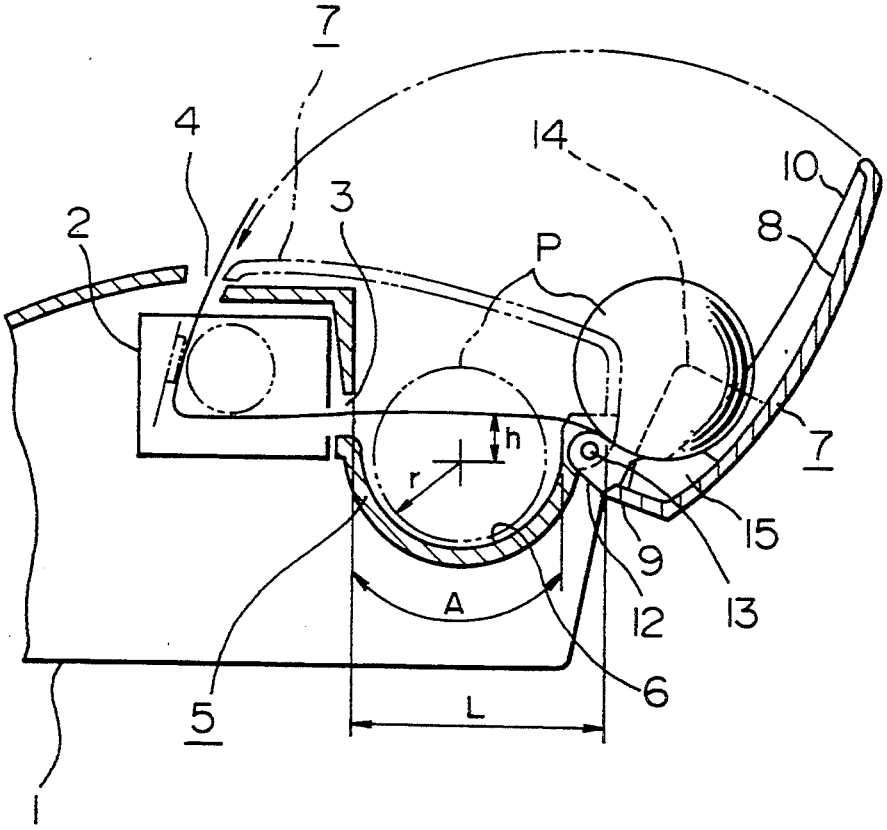
FIG. 2 is a cross-sectional view of an important portion of the terminal device in the open condition of the paper roll cover.
Figure 3:
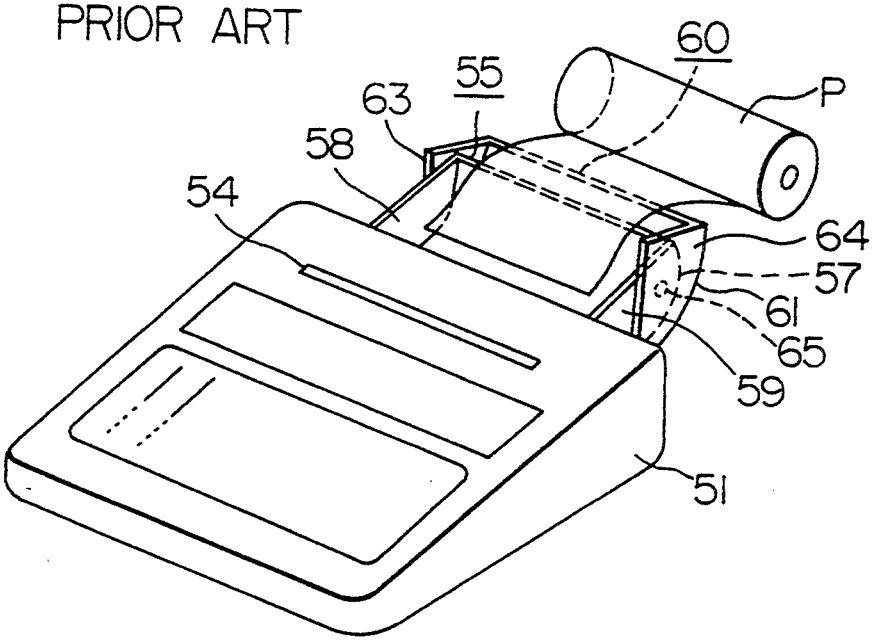
FIG. 3 PRIOR ART
FIG. 3 is a perspective view of a conventional terminal device in an open condition of a paper roll cover.
Figure 4:
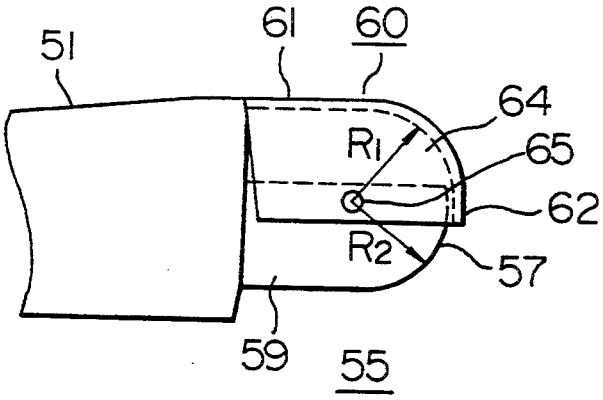
FIG. 4 PRIOR ART
FIG. 4 is a side-elevational view of an important portion of the conventional terminal device in a closed condition of the paper roll cover.
Figure 5:
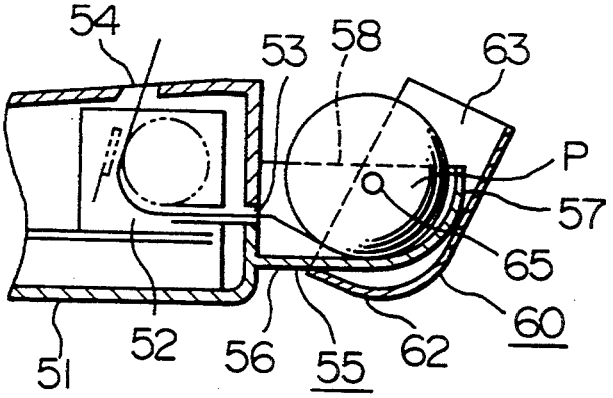
FIG. 5 PRIOR ART
FIG. 5 is a cross-sectional view of an important portion of the conventional terminal device in the open condition of the paper roll cover, showing a paper roll set in position.

FIGS. 1 and 2 show a preferred embodiment of a terminal device of the present invention. More specifically, FIG. 1 is a perspective view of the terminal device in an open condition of a paper roll cover, and FIG. 2 is a cross-sectional view of an important portion of the terminal device in the paper roll cover.

As shown in FIGS. 1 and 2, a printer unit 2 is accommodated in a rear portion of a terminal device body 1. A paper insertion slot 3 for supplying paper P to the printer unit 2 from the paper roll is formed through a rear end wall of the body 1, and a paper discharge slot 4 for discharging the paper P, passed through the printer unit 2, is formed through an upper wall of the body 1 adjacent to the rear end thereof. A paper roll receptacle portion 5 is formed integrally on the rear end surface of the body 1, and is open upwardly, and has an inner bottom surface 6 of an arcuate shape which is continuous with the paper insertion slot 3. A paper roll cover 7 comprises a gently-curved top plate 8, a rear plate 9, and opposite side plates 10 and 11 of a relatively small width, the paper roll cover 7 being open at its front and bottom. The paper roll cover 7 is pivotally mounted at its proximal end portion on the rear end of the paper roll receptacle portion 5. More specifically, the paper roll cover 7 has a pair of connecting portions 12 provided respectively at opposite side portions of the rear plate 9. The paper roll cover 7 is pivotally connected at its connecting portions 12 to the upper portion of the rear end of the paper roll receptacle portion 5 by a pair of pivot pins 13. The paper roll cover 7 can be pivotally moved about the pivot pins 13 into an open position (as indicated in solid lines in FIGS. 1 and 2) where the paper roll cover is inclined slightly rearwardly of the paper roll receptacle portion 5 to open the top of the paper roll receptacle portion. Also, the paper roll cover 7 can be pivotally moved about the pivot pins 13 in a reverse direction to close the top of the paper roll receptacle portion 5, as indicated in phantom in FIG. 2. A pair of position limiting members 14 for limiting the movement of the paper roll in the direction of the width of the terminal device are integrally formed on the inner surface of the top plate 8 of the paper roll cover 7, and are disposed at the opposite side portions of the top plate 8, respectively. Each position limiting member 14 is in the form of a rib. A pair of position limiting members 15 for limiting the movement of the paper roll in the direction of the height are also formed integrally on the inner surface of the top plate 8, and are disposed between the first-mentioned position limiting members 14. Each position limiting member 15 is in the form of a rib. In the open condition of the paper roll cover 7 where the paper roll cover 7 is inclined slightly rearwardly of the paper roll receptacle portion 5, the roll of paper P can be held in position by the position limiting members 14 and 15 in such a manner that the paper roll is disposed in registry with the paper insertion slot 3.

In FIG. 2, L represents the length of straight drawing of the paper P from the lower side of the paper roll (which is supported on the paper roll cover 7 in its open condition) to the paper insertion slot 3, A represents the length of the arcuate inner surface 6 (with which the paper roll in the receptacle portion 5 is in contact) extending up to the paper insertion slot 3, r represents a radius of the paper roll, and h represents the distance (height) between the center of the paper roll received in the paper roll receptacle portion 5 and the position of the paper P drawn out from the paper roll supported by the paper roll cover 7. The pivot pin 13 and the vertical position-limiting members 15 are so set or determined that the length L can be shorter than the length A, that is, $L<A=\pi\cdot r+2\cdot h$ can be established when the paper roll is supported on the paper roll cover 7 in its open condition. With this arrangement, when the roll of paper P having its leading end inserted in the paper insertion slot 3 is caused to rollingly drop into the paper roll receptacle portion 5 in response to the pivotal movement of the paper roll cover 7 into its closed position, the drawn-out portion of the paper roll is again wound on the paper roll, and thus the paper roll is received in the paper roll receptacle portion 5 without a slack.

The operation of the terminal device of the above construction will now be described.

First, as shown in FIG. 1 and FIG. 2 (in solid lines), the paper roll cover 7 is pivotally moved about the pivot pin 13 to be inclined slightly rearwardly of the terminal device body 1, thereby opening the paper roll receptacle portion 5. In this condition, the roll of paper P is placed on the inner side of the paper roll cover 7, and the paper roll is held by the position limiting members 14 and 15 against movement in the vertical direction and the widthwise direction, thereby keeping the distance from the paper roll to the paper insertion slot 3 constant. Then, the paper P is drawn out from the lower side of the paper roll, and the leading end of the paper P is held by the fingers of both hands, and is inserted into the paper insertion slot 3. At this time, the amount of drawing of the paper from the paper roll is always constant, and the paper roll is held in position by the paper roll cover 7 and the position limiting members 14 and 15. Therefore, the paper roll will not be displaced out of position and will not roll, so that the paper P can be inserted into the paper insertion slot 3 in a stable condition. Then, the paper P is fed by a paper feed mechanism to pass through the printer unit 2, so that the leading end portion of the paper P is extended from the paper discharge slot 4. Then, the paper roll cover 7 is pivotally moved about the pivot pin 13 to cause the paper roll to rollingly drop into the paper roll receptacle portion 5, and also to close the open top of the paper roll receptacle portion 5. As described above, the height of the pivot pin 13 (about which the paper roll cover 7 pivotally moves) and the height of the position limiting members 15 for the paper roll are so determined that the length L of drawing of the paper P from the lower side of the paper roll (which is supported on the paper roll cover 7 in its open condition) to the paper insertion slot 3 is shorter than the length A of the arcuate inner surface 6 (with which the paper roll in the receptacle portion 5 is in contact) extending up to the paper insertion slot 3. With this arrangement, when the paper roll is caused to rollingly drop into the paper roll receptacle portion 5, the drawn-out portion of the paper P is again wound on the paper roll, and thus the paper roll is received in the paper roll receptacle portion 5 without a slack.

In the present invention, the axis of pivotal movement of the paper roll cover is provided at the rear end portion of the paper roll receptacle portion, and therefore the paper roll cover is opened about the pivotal axis to be disposed rearwardly of the paper roll receptacle portion, so that the paper roll cover can be sufficiently spaced from the paper insertion slot. Further, the position limiting member limits the position of the paper roll, supported on the inner side of the paper roll cover, in such a manner as to hold the paper roll in registry with the paper insertion slot. Thus, the paper roll supported on the paper roller cover in the open position can be held in registry with the paper insertion slot. And besides, the paper roll can be spaced a sufficient distance from the paper insertion slot, and therefore the paper can be drawn out from the paper roll and can be positively inserted into the paper insertion slot by both hands. Therefore, the insertion of the paper from the paper roll into the paper insertion slot can be effected easily.

Furthermore, the length of straight drawing of paper from the lower side of the paper roll (which is supported on the inner side of the paper roll cover in its open position) to the paper insertion slot is shorter than the length of that portion-of the paper roll receptacle portion with which the paper roll is in contact when the paper roll is received in the paper roll receptacle. With this arrangement, when the roll cover supporting the paper roll thereon is moved into the closed position, the paper roll can be set or loaded in position without producing a slack on the paper roll. Therefore, the reception of the paper roll into the paper roll receptacle portion can be easily effected.

What is claimed is:

1. A terminal device comprising:

a terminal device body having a paper insertion slot;

a paper roll receptacle portion provided on said terminal device body for receiving a paper roll of radius r, said paper roll receptacle portion having an open top and having a surface which is in contact with said paper roll when said paper roll is received in said paper roll receptacle portion, said surface having a circumferential length A measured in a direction in which paper is wound on said paper roll; and a paper roll cover having a proximal end portion pivotally mounted on a rear end portion of said paper roll receptacle portion so as to pivotally move between an open position where said paper roll cover opens the open top of said paper roll receptacle portion and a closed position where said paper roll cover closes the open top of said paper roll receptacle portion, said paper roll cover having means for supporting the paper roll thereon when said paper roll cover is in the open position to define a drawing path of length L between said paper roll and said paper insertion slot and means for rolling said paper roll supported on said paper roll cover into said paper roll receptacle portion as said paper roll cover is moved to its closed position, said paper roll receptacle portion being positioned such that said drawing path is separated by a distance h from a location occupied by an axis of said paper roll when said paper roll is disposed in said paper roll receptacle portion, with r, A, L and h being selected to satisfy $$L<A=\pi r+2h.$$

2. A terminal device according to claim 1, in which L is less than a length of a portion of said surface of said paper roll receptacle portion with which the paper roll is in contact when the paper roll is received in said paper roll receptacle portion.

3. A terminal device according to claim 1, further comprising a position limiting means for holding said paper roll in registry with said paper insertion slot when said paper roll cover is in said open position, said position limiting means allowing said paper roll to rollingly drop from said paper roll cover into said paper roll receptacle portion when said paper roll cover is moved from said open position to said closed position.

4. A terminal device according to claim 3, wherein said position limiting means comprises a pair of position limiting members, disposed on an inner surface of said paper roll cover, for limiting a movement of said paper roll along said axis of said paper roll.

5. A terminal device according to claim 3, wherein said position limiting means comprises a pair of position limiting members, disposed on an inner surface of said paper roll cover, for limiting a movement of said paper roll in a direction perpendicular to said axis of said paper roll.

6. A terminal device according to claim 3, wherein said position limiting means comprises:

a first pair of position limiting members, disposed on an inner surface of said paper roll cover, for limiting a first movement of said paper roll along said axis of said paper roll; and a second pair of position limiting members, disposed on said inner surface of said paper roll cover between said first pair of position limiting members, for limiting a second movement of said paper roll in a direction perpendicular to said axis of said paper roll.

7. A terminal device according to claim 1, wherein said paper roll cover comprises a pair of connecting portions which are connected to said paper roll receptacle portion by pivot pins.

8. A terminal device according to claim 1, wherein said surface of said paper roll receptacle portion has an accurate shape.

* * * * *